United States Patent [19]

Ramik

[11] Patent Number: 4,509,538

[45] Date of Patent: Apr. 9, 1985

[54] HAIR STREAKING IMPLEMENT

[76] Inventor: Vincent L. Ramik, 4966 Sabra Ln., Annandale, Va. 22003

[21] Appl. No.: 590,489

[22] Filed: Mar. 16, 1984

[51] Int. Cl.[3] ..... A45D 1/00

[52] U.S. Cl. ..... 132/9

[58] Field of Search ..... 132/9; 128/20, 340

[56] References Cited

U.S. PATENT DOCUMENTS

| | | | |
|---|---|---|---|
| 3,302,653 | 2/1967 | D'Agostino | 132/9 |
| 3,390,689 | 7/1968 | Newman | 132/9 |
| 3,468,318 | 9/1969 | Cook et al. | 132/9 |
| 3,651,800 | 3/1972 | Wilbanks | 128/20 |
| 3,857,386 | 12/1974 | Ashbell | 128/20 |

*Primary Examiner*—Gregory E. McNeill

*Attorney, Agent, or Firm*—Diller, Ramik & Wight

[57] ABSTRACT

This disclosure relates to an implement particularly adapted for engaging groups of hair and withdrawing the groups of hair through an associated frosting cap incident to tinting, frosting, streaking, dyeing or otherwise treating and/or coloring the hair, the implement including a generally elongated cylindrical body of one piece homogeneous polymeric/copolymeric material, a pair of generally oppositely directed hook portions carried one at each of axially opposite ends of the body, each hook portion including a shank and a hook, the hooks being of different sizes, the shank being common to and integral with the hooks or alternatively each hook portion including a separate shank individual to its associated hook, means defined by the shank or shanks for preventing relative axial and rotational movement between the hook portions and the body and for securing the same together, and a cap housing each hook in partial external telescopic relationship to an associated one of the body ends whereby each cap can be selectively removed to expose the associated hook for withdrawing groups of hair as aforesaid.

18 Claims, 6 Drawing Figures

HAIR STREAKING IMPLEMENT

This invention is directed to an implement particularly adapted for engaging groups of hair and withdrawing the groups through an associated frosting cap preferably, though not necessarily, of the type disclosed in U.S. Pat. No. 4,267,850 in the name of Eileen Barrett issued on May 19, 1981. As is disclosed in the latter-identified patent, a conventional crochet hook or needle is commonly employed by being inserted through the frosting cap with a hook thereof being utilized to engage a group of hair which is pulled through the cap. When a plurality of such groups of hair are pulled through the cap each group or the totality might then be bleached, colored, "frosted" or otherwise treated to distinguish the group of groups from the remaining mass of hair thus imparting a "frosted" or "streaked" look to the overall hair mass. For years this operation was performed by a conventional crochet needle and obviously the narrow nature thereof resulted in finger fatigue of the operator, particularly when it is realized that an overall tinting operation of this type could involve up to three hours of the aforesaid operation depending, of course, upon the skill of the operator.

Very recently an improvement has been made in the conventional crochet needle by simply incorporating the same in the barrel of a standard ballpoint pen and utilizing a spacer or spacers and glue to maintain the crochet needle within the conventional pen barrel. When not in use a conventional pen cap closed over the exposed hook of the crochet needle.

In keeping with the foregoing a novel implement has been unobviously devised which overcomes the fatigue latter-noted, can be manufactured at low cost, is constructed of a minimum of parts and can be utilized in a selective manner heretofore unprovided for by known prior art devices utilized in the manner heretofore described for frosting hair.

In keeping with the present invention there is provided a novel implement for engaging groups of hair and withdrawing the same through an associated frosting cap as aforesaid, wherein a cylindrical body is formed of a one piece homogeneous copolymeric/-polymeric material, a pair of generally oppositely hooked portions carried out at each of axially opposite ends of the body, each hook portion including a shank and a hook, the hooks being of different sizes and a cap housing each hook in partial external telescopic relationship to an associated one of the body ends whereby each cap can be selectively removed to expose the associated different sized hooks for withdrawing groups of hair as aforesaid.

Still another object of this invention is to provide a novel implement of the type immediately latter-described wherein the shank is common to and integral with the hooks or alternatively each hook portion includes a separate shank individual to its associated hook.

Still another object of this invention is to provide a novel implement as aforesaid wherein means are provided for preventing relative rotational and axial movement between the hook portions and the body.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
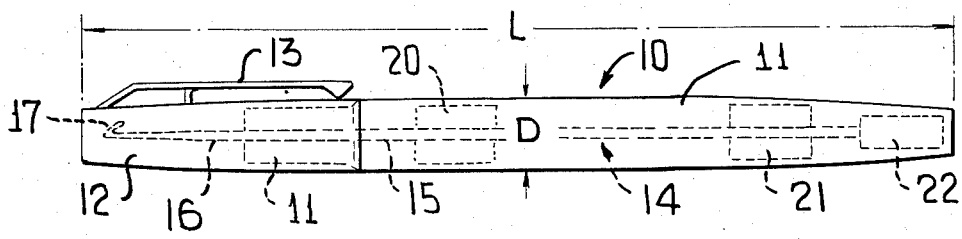
FIG. 1 (PRIOR ART)
FIG. 1 is a side elevational view of a prior art implement and illustrates a conventional ballpoint pen cap and a body or barrel with the latter having housed therein a conventional crochet needle.
Figure 2:
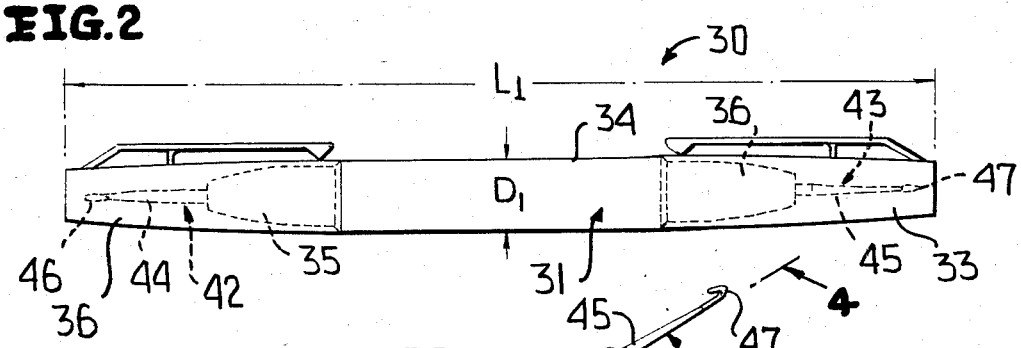
FIG. 2 is a side elevational view of a novel implement of this invention and illustrates a one-piece body having hooked portions projecting from axially opposite ends with each being covered by a cap.
Figure 3:
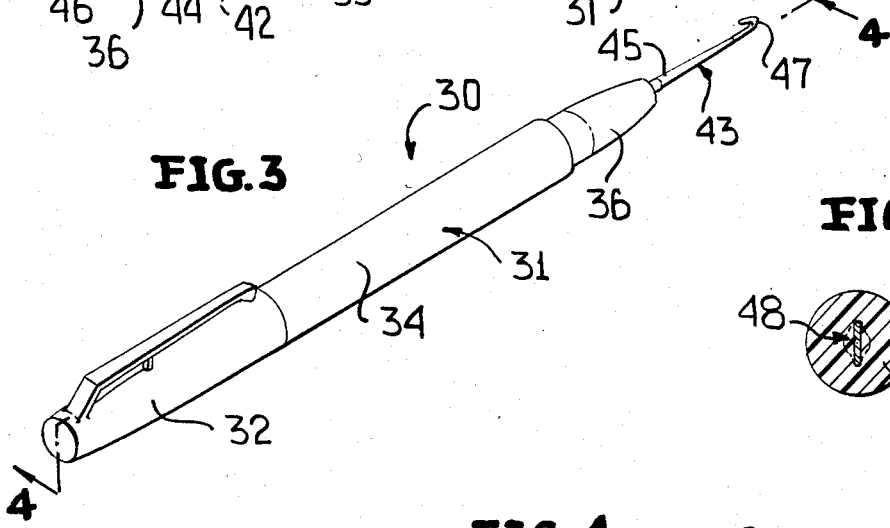
FIG. 3 is a perspective view of the implement of FIG. 2 and illustrates one of the caps removed therefrom.
Figure 5:
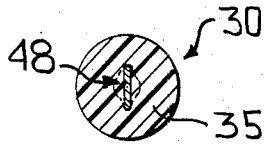
FIG. 5 is a cross sectional view taken generally along line 5—5 of FIG. 4 and illustrates a flat portion of one of the shanks which precludes the axial/relative motion heretofore described.

Reference is made to FIG. 1 of the drawings which illustrates a conventional implement for withdrawing groups of hair through frosting or streaking caps as aforesaid with the overall length L of the implement being approximately five inches. The implement is generally designated by the reference numeral 10 and is defined in part by a conventional injection molded ballpoint pen barrel 11 and a conventional injection molded cap 12 having a pocket clip 13. The barrel 11 partially houses a conventional crochet needle 14 having a shank 15, a hook portion 16 and a hook 17. A pair of plastic sleeves 20, 21 tightly embrace the shank 15 of the crocket needle 14 and bind the same within the interior of the barrel 11. A spacer 22 within the barrel 11 exposes the desired length of the end portion 16. Obviously, when it is desired to utilize this implement, the cap 12 is simply removed, the barrel 11 is grasped and the hook 17 is manipulated in the manner heretofore described relative to U.S. Pat. No. 4,267,850. Suffice it to note that the prior art implement 10 is formed of a multiplicity of separate elements evidencing relative high expense both as to cost of parts and assembly thereof. The diameter D of the barrel 11 does, however, provide more comfort for a user than that available to a person using the crochet needle per se. Thus though the prior art implement 10 solves one problem it does present others in terms of cost of parts and cost of assembly.

In keeping with the foregoing, the present invention provides an implement 30 which is particularly adapted in the same manner for engaging groups of hair and withdrawing groups of hair through an associated frosting cap, such that the same may be tinted, frosted, streaked, dyed or otherwise treated or colored, as more specifically described in U.S. Pat. No. 4,267,850.

The implement 30 includes a body 31, two identical caps 32, 33, and two dissimilar, not identical hook portions 42, 43. With the caps 32, 33 assembled upon the body 31, the overall length L1 of the implement 30, corresponds to the five inch length L of the prior art conventional implement 10 and the diameters D, D1 are essentially the same, corresponding generally to that of the length and diameter of a conventional ballpoint pen. However, the body 31 of the implement 30 is formed as a mass of relatively resilient, yielding homogeneous compression molded or injection molded polymeric/-copolymeric plastic material defining a central body portion 34 and axially opposite conically tapering terminal end portions 35, 36 having respective conical tapering outer surfaces 37, 38 and oppositely directed shoulders 39, 40. Preferably the copolymeric/polymeric plastic material has the softness and resilience of natural rubber, and typical synthetic elastomers are isoprene rubber and styrene-butadiene rubber (SBr).

Figure 4:
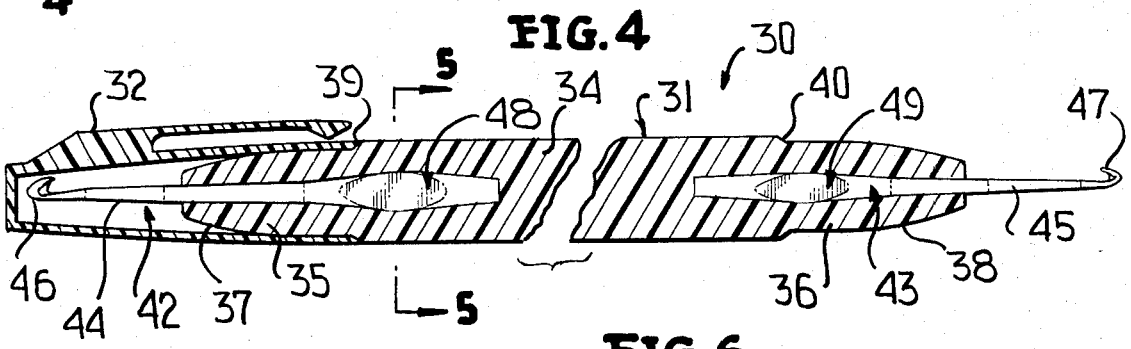
FIG. 4 is a slightly enlarged axial sectional view taken through the implement of FIG. 3 along the line 4—4 thereof and illustrates the manner in which hook shanks are imbedded in the body and precluded from rotating or axially moving relative thereto.

Imbedded within the body 31 during the compression/injection molding operation are the hook portions 42, 43, each of which includes respective shanks 44, 45 and respective hooks 46, 47 which are of different sizes, as is most readily apparent from FIG. 4. Each of the hook portions 42, 43 also include means 48, 49, respectively, in the form of a flattened portion of the overall cylindrical shanks 44, 45 which form an interlock with the material of the body 31 during the compression molding or injection molding thereof, thus preventing relative axial and rotational movement of the hook portions 42,43 relative to the body 31. Thus when the hooks 46/47 are alternatively utilized during the operation heretofore described and more fully described in U.S. Pat. No. 4,267,850, the same will not become disengaged from the body 31. Obviously, during the latter one or the other of the caps 32, 33 is removed but the other is retained in position, shown in FIG. 4, to preclude injury to the operator or another from the particular hook portion which is not being utilized (the hook portion 42 of FIG. 4) when the other hook portion 43 is exposed and utilized.

Thus, in keeping with the foregoing description the overall implement 30 is formed but of five parts in the absence of a separate assembly operation due to the in situ molding of the hook portions 42, 43 relative to the body 31. Moreover, since the hooks 46, 47 are of different sizes, a single tool can perform to different functions, namely, engaging more or less numbers of hair in each group depending upon which hook is utilized and doing so without two separate implements and without overall increase in length (compare L1 to L).

Figure 6:
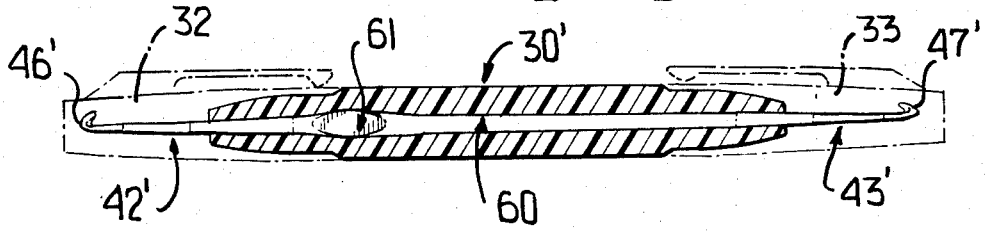
FIG. 6 is an axial sectional view through another implement of this invention, and illustrates an implement identical to that shown in FIGS. 2–5 except a single shank of an integral one-piece construction is provided at its opposite ends with hooks of different sizes.

Reference is now made to FIG. 6 in which like elements have been designated with like through primed reference numerals as those appearing in FIGS. 1–5. The only difference between the implement 30' of FIG. 6, as compared to the implement 30, is that the implement 30' has but a single integral shank 60 having opposite hook portions 42',43' and hooks 46',47' of different sizes and but a single means 61 corresponding to the means 48, 49 for interlocking securing the shank 60 to the body 31' to prevent both rotational and axial movement relative therebetween.

Although only a preferred embodiment of the invention has been specifically illustrated and described herein, it is to be understood that minor variations may be made in the apparatus without departing from the spirit and scope of the invention, as defined in the appended claims.

I claim:

1. An implement particularly adapted for engaging groups of hair and withdrawing the groups through an associated frosting cap whereby the hair groups can be tinted, frosted, bleached or the like comprising a generally elongated body of one piece homogeneous copolymeric/polymeric material, a pair of generally oppositely directed hook portions carried one at each of axially opposite ends of said body, each hook portion including a shank and a hook, said hooks being of different sizes, said elongated body being formed in situ molded relative to said shank, and a cap housing each hook in partial external telescopic relationship to an associated one of said body ends whereby each cap can be selectively removed to expose the associated hook for withdrawing groups of hair as aforesaid.

2. The implement as defined in claim 1 wherein said shank is common to and integral with said hooks.

3. The implement as defined in claim 1 wherein each hook portion includes a separate shank individual to its associated hook.

4. The implement as defined in claim 1 including means for preventing relative movement between said hook portions and said body.

5. The implement as defined in claim 1 including means between said shank and body for preventing relative movement between said hook portions and said body.

6. The implement as defined in claim 1 including means between said shank and body for interlockingly securing the same together to prevent both axial and rotational relative movement between said hook portions and said body.

7. The implement as defined in claim 2 wherein said hook portions are generally axially aligned.

8. The implement as defined in claim 2 including means for preventing relative movement between said hook portions and said body.

9. The implement as defined in claim 2 including means between said shank and body for preventing relative movement between said hook portions and said body.

10. The implement as defined in claim 2 including means between said shank and body for interlockingly securing the same together to prevent both axial and rotational relative movement between said hook portions and said body.

11. The implement as defined in claim 3 including means for preventing relative movement between said hook portions and said body.

12. The implement as defined in claim 3 including means between said shank and body for preventing relative movement between said hook portions and said body.

13. The implement as defined in claim 3 including means between said shank and body for interlockingly securing the same together to prevent both axial and rotational relative movement between said hook portions and said body.

14. The implement as defined in claim 8 wherein said body is compression molded.

15. The implement as defined in claim 8 wherein said body is injection molded.

16. The implement as defined in claim 11 wherein said body is compression molded.

17. The implements defined in claim 11 wherein said body is injection molded.

18. An implement particularly adapted for engaging groups of hair and withdrawing the groups through an associated frosting cap whereby the hair groups can be tinted, frosted, bleached or the like comprising a generally elongated body of one piece homogeneous copolymeric/polymeric material, a shank having a first end portion within said body and a second end portion projecting outwardly of said body, said second end portion terminating in a hook, said body being formed in situ relative to said shank, and said second end portion having at least one flat face located within and intimately associated with a like opposing flat internal face of said homogeneous material body whereby said flat-face to flat-face relationship prevents relative rotation between said shank and body.

* * * * *